US006325313B1

(12) United States Patent
Andre

(10) Patent No.: US 6,325,313 B1
(45) Date of Patent: Dec. 4, 2001

(54) DEVICE FOR FEEDING A MATERIAL TREATING PLANT AND VIBRATORY MILL EQUIPPED WITH SAME

(75) Inventor: Jean-François Andre, Villette de Vienne (FR)

(73) Assignee: FCB Societe Anonyme, Montreuil (FR)

( * ) Notice: Subject to any disclaimer, the term of this patent is extended or adjusted under 35 U.S.C. 154(b) by 0 days.

(21) Appl. No.: 09/446,285

(22) PCT Filed: Jun. 26, 1998

(86) PCT No.: PCT/FR98/01354

§ 371 Date: Feb. 14, 2000

§ 102(e) Date: Feb. 14, 2000

(87) PCT Pub. No.: WO99/01222

PCT Pub. Date: Jan. 14, 1999

(30) Foreign Application Priority Data

Jun. 30, 1997 (FR) ..... 97 08458

(51) Int. Cl.[7] ..... B02C 2/00

(52) U.S. Cl. ..... 241/202; 241/262

(58) Field of Search ..... 241/202, 262, 241/207–216, 261.1

(56) References Cited

U.S. PATENT DOCUMENTS

| | | | | |
|---|---|---|---|---|
| 2,656,120 | * | 10/1953 | Roubal | 241/202 |
| 3,446,444 | * | 5/1969 | Kern | 241/202 |
| 3,813,046 | | 5/1974 | Kemnitz et al. . | |
| 4,651,933 | * | 3/1987 | Schitte et al. | 241/202 |

FOREIGN PATENT DOCUMENTS

| | | |
|---|---|---|
| 1228896 | 5/1986 | (SU) . |
| 274636 | 3/1992 | (SU) . |
| 1726016 | 4/1992 | (SU) . |
| WO90/41680 | 12/1996 | (WO) . |

* cited by examiner

*Primary Examiner*—Mark Rosenbaum
(74) *Attorney, Agent, or Firm*—Harrison & Egbert

(57) ABSTRACT

A device (1) for feeding a material processing plant (2) such as, in particular, a crusher, including an outer shell (3) and a bell (6), provided at least internally in the outer shell (3) and secured to the latter, the bell (6) being provided so as to be orientated substantially parallel to the direction of flow of the material in such a way as to enable the material to be diverted to protect members (9), provided downstream, of the plant (2).

10 Claims, 2 Drawing Sheets

DEVICE FOR FEEDING A MATERIAL TREATING PLANT AND VIBRATORY MILL EQUIPPED WITH SAME

TECHNICAL FIELD

The present invention relates to a feeding device for a material processing plant, as well as to a vibrating vertical cone crusher equipped with such a device.

However, although more especially intended for such applications, the feeding device can also be used, in particular, with other types of crushers and breakers.

BACKGROUND ART

In order for a vibrating cone crusher to be able to function correctly, it is preferable for the machine to operate under load, that is to say for its crushing chamber be continually fed with materials. Quite particular care thus has to be devoted to the design of its feeding system.

At the present time, the most conventional one of the feeding systems is the chute, which is fixed to the apparatus itself. The shape and dimensions can vary according to the technology used for the crusher.

While such devices ensure that the crushing chamber is fed, they nonetheless have the drawback of generating a static pressure, which is due, in particular, to the mass of the materials which impairs the efficiency of the machine and restricts its performance.

To overcome these drawbacks, certain devices have been devised, such as, those having a rotating chute.

Another device has also been developed, this device consisting of a small hopper integral with the cone crusher, but having a flat bottom equipped with two horizontal disks.

One of the disks is fixed and integral with the cylindrical, vertical wall, and has openings in the form of spiral arcs centered on the arc of the disk. The second disk, which is mobile, comprises the same openings, but these are a little wider.

The displacement of this disk by a jack makes it possible to control the openings partially by distributing feeding into the crushing chamber.

Another known device is constituted by a shaft emerging onto a distribution plate, provided above the crusher and integral, or otherwise, with the central cone of the crusher, in such a way as to distribute the material flowing into the crushing chamber around the cone.

Such devices have the drawback, however, of only permitting the processing of fine grain sizes.

Furthermore, in storage hoppers or silos, there are known discharge devices having a conical central unit at the base of the hopper, designed to vibrate to facilitate the flow of the stored materials when these tend to stick and/or form inversed U shapes. The material is then re-centered before it leaves the hopper.

It is noted, therefore, that all of the aforementioned devices lead, when used in a cone crusher, to the presence of material in the area of the upper portion of the cone, thus giving rise to wear forces generating wear, power consumption and considerable mechanical stress, which may be unnecessary.

The object of the invention is to provide a feeding device that overcomes the aforementioned drawbacks and makes it possible to protect certain members of the plant equipped with the said device, in particular from wear phenomena.

Another object of the present invention is to provide a feeding device that can be used with materials having grain sizes that can vary over a wide range.

Another object of the present invention is to provide a device that enables the plant equipped with the said device to be fed continuously while, at the same time, controlling static pressure.

A further object of the present invention is to provide a vibrating cone crusher, equipped with a feeding device, in which wear in the upper, possibly non-active, portions of the cone is reduced or eliminated.

Another object of the present invention is to provide a vibrating cone crusher, equipped with a feeding device, in which the mechanical stresses exerted on the cone are considerably reduced and/or displaced.

Another object of the present invention is to provide a vibrating cone crusher, equipped with a feeding device, in which the static pressure inside the crushing chamber can be controlled.

Further objects and advantages of the present invention will emerge in the course of the following description, which is given only by way of illustration and is not intended to limit same.

SUMMARY OF THE INVENTION

According to the invention, the feeding device for the material processing plant such as, or instance, a crusher, includes an outer envelope, or shell, and a bell, provided at least internally in the outer shell and secured to the latter, the bell being provided so as to be orientated substantially parallel to the direction of flow of the material in such a way as to permit diversion of the material to protect members, provided downstream, of the plant.

The invention also relates to a vibrating vertical cone crusher equipped with such a feeding device.

BRIEF DESCRIPTION OF THE DRAWINGS

It will be more readily understood from a study of the following description, accompanied by the annexed drawings, which form an integral part thereof, and wherein.

DETAILED DESCRIPTION OF THE INVENTION

The present invention relates to a device for feeding a material processing plant such as, in particular, a crusher. This can thus be, a feeding device in which the flow of material is facilitated by vibrations generated by the plant.

Figure 1:
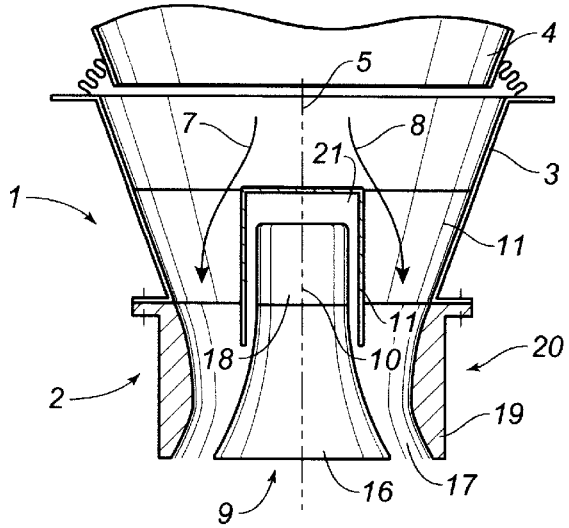
FIG. 1 illustrates, in a diagrammatic radial cross-sectional view, a first exemplary form of embodiment of the feeding device according to the invention.
Figure 2:
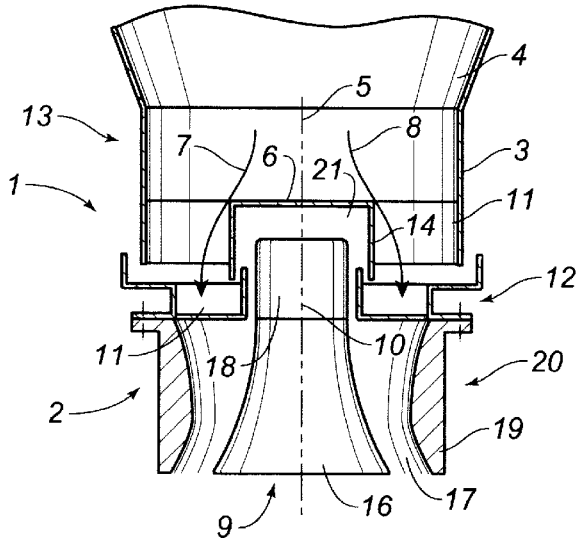
FIG. 2 illustrates, in a diagrammatic radial cross-sectional view, a second exemplary form of embodiment of the feeding device according to the invention.
Figure 3:
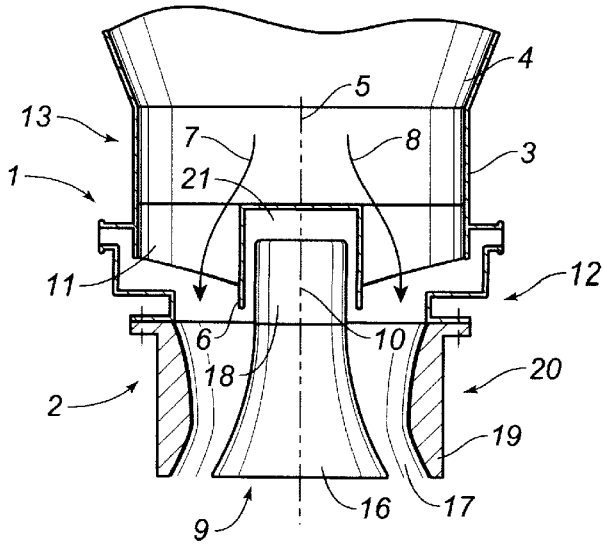
FIG. 3 illustrates, in a diagrammatic radial cross-sectional view, a third exemplary form of embodiment of the feeding device according to the invention.

As shown in FIGS. 1 to 3, device 1, according to the invention, for feeding a material processing plant 2 includes an outer shell 3. The latter is located, for example, underneath a storage hopper 4, from which the material flows, in particular by gravity feed.

The outer shell 3 has, a rotationally symmetrical shape, in particular frustoconical or cylindrical. Its axis of symmetry 5 is orientated, substantially vertically, in particular in the prolongation of the longitudinal axis of the hopper 4 and/or of that of the plant 2, which are, for their part too, as applicable, provided so as to be substantially vertical.

According to the invention, the feeding device 1 also includes a bell-shaped element 6, provided at least internally in the outer shell 3 and secured to the latter. The bell 6 is provided so as to be orientated substantially parallel to direction of flow of the material. The latter can thus be diverted, in the directions of arrows 7, 8, thus making It possible to protect the members 9 of the plant 2.

In fact, the member or members that are provided downstream are no longer, at least partially, in contact with the material. The expression providing downstream is to be taken as meaning, in particular, that the members 9 are located downstream of the feeding device 1, beneath the bell 6, and/or, as shown, are capped by the bell 6.

The bell 6 is provided, in particular, so as to be level with and/or emerge at the exit from the outer shell 3. It thus favors annular distribution of the material. Furthermore, the bell 6 has, a rotationally symmetrical shape, for instance cylindrical or cylindroconical.

According to the different exemplary forms of embodiment illustrated, the material flows vertically and the axis of symmetry 10 of the bell 6 is provided, for its part also, as apparent from the explanations given above, so as to be orientated substantially in the same direction.

The outer shell 3 and the bell 6 are secured to one another, particular, by means of wing members 11, provided so as to be vertical and distributed uniformly around the said axis of symmetry 10 of the bell 6.

Feeding device 1 according to the invention thus includes, in particular, three wing members 11, disposed in a star configuration and spaced apart from one another by 120°, or four wing members, spaced apart from one another by 90°.

The wing members 11 can be provided, as applicable, so as to be orientatable, by each pivoting about a substantially horizontal axis. In this way, they will make it possible, in particular, to adjust the flow rate of material by closing to a greater or lesser extent the passage between bell 6 and outer shell 3, and to moderate the static load.

As illustrated, the outer shell 3 the bell 6 and/or the member 9 are for coaxial.

Figure 4:
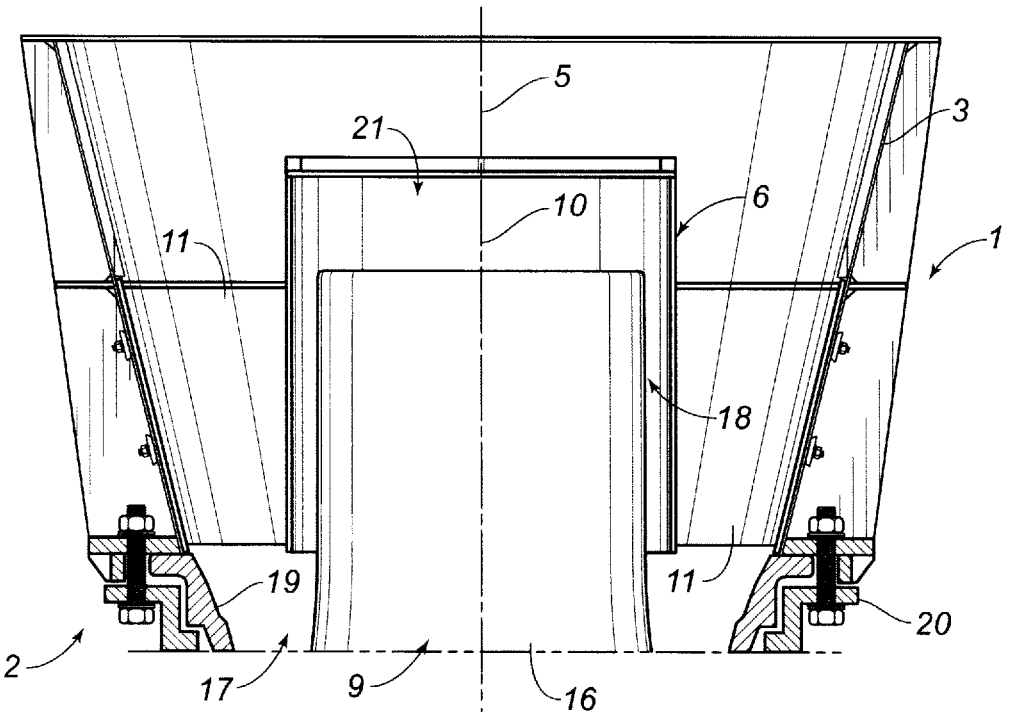
FIG. 4 details the exemplary form of embodiment shown in above FIG. 1.
Figure 5:
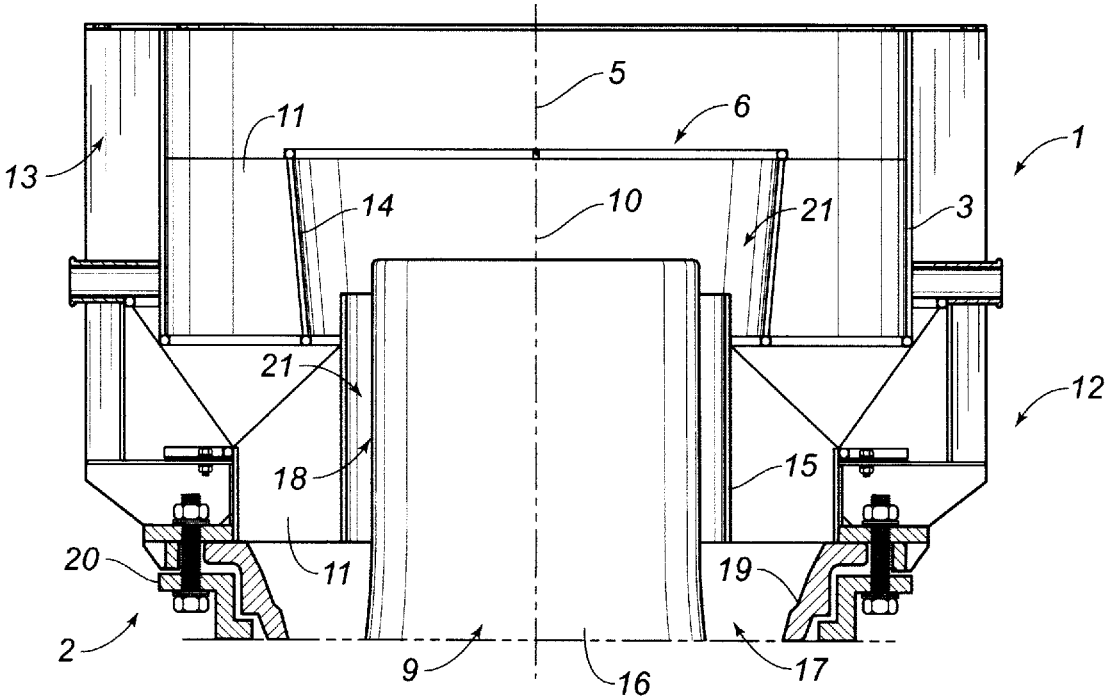
FIG. 5 details the exemplary form of embodiment shown in above FIG. 2.

With reference, now, to FIG. 4, it will be noted that, according to a first form of embodiment, the outer shell 3 is made in one piece. According to another form of embodiment, illustrated in FIG. 5, the outer shell 3 is constituted by a lower element 12, referred to hereinafter as the 'chute', and by an upper element, 13, emerging in the chute 12.

Furthermore, as illustrated in FIGS. 1, 3 and 4, the bell 6 is, made in one piece or, as illustrated in the other figures, constituted by a cupola 14 and by a tubular element 15, fitting into the cupola 14.

When the outer shell 3 is formed, as mentioned earlier, by two independent elements 12, 13, the bell 6, when it is made in one piece, and/or its cupola, when it is not, are, in particular, secured to the upper element 13. As to the tubular element 15, this is, mounted on the chute 12.

According to certain applications, it can also be contemplated providing a bell 6 rising upstream of the outer shell 3 and thus emerging, in hopper 4.

The present invention also relates to a vibrating crusher 2 with a vertical cone 16 and a crushing chamber 17 equipped with a feeding device 1 as described earlier, As mentioned earlier, the device 1 Is provided between a storage hopper 4 and the crusher 2 and enables the tatter to be fed with material, in particular through the combined effect of gravity and/or the vibrations generated by the crusher 2.

Bell 6 of the said feeding device 2 is provided, above crushing chamber 17 of the crusher 2 and thus makes it possible to protect members 9 provided therein by isolating them, at least partially, from the flow of material.

This concerns, in particular, the cone 16 provided, according to the different exemplary forms of embodiment illustrated, so as to emerge externally above the crushing chamber 17. Bell 6 is then provided so as to be capable of capping, at least partially, the emerging end 18 of the cone 16, a residual space 21 being provided between these two members.

As it is no longer directly surrounded by material in the area of the end 18, the cone 16 is free in its movements, at the very least in this area, that is to say, in particular, in a zone wherein the cone 16 does not play a part in fragmentation.

Wear is thus avoided. In addition, this absence of material and the reduction in the static pressures between pieces 16 and 19, obtained thanks to the isolation provided by bell 6, considerably reduce the mechanical stresses exerted on cone 16, the latter then being able to vibrate, move and/or rotate while subjected to lesser forces.

The cone 16 and the bell 6 are, in particular, as already mentioned earlier, provided so as to be coaxial.

As regards the crusher 2, the latter includes, by way of example, a frame 20 having a vibrating ring 19 provided, at least partially, facing the cone 16.

The ring 19 is vibrated, in particular, by means of a vibrating device with unbalance weights, not shown, mounted on frame 20, and thus enables the material to be crushed against the cone 16.

The ring 19 and the cone 16 are, in particular, coaxial, the cone 16 being possibly free to rotate about its longitudinal axis in such a way as to facilitate the flow of the material during crushing.

As mentioned earlier, according to the different exemplary forms of embodiment illustrated, the end 18 of the cone 16 is provided so as to emerge above the ring 19.

According to a first form of embodiment, the bell 6 protects the upper end 18, in particular, over the entire corresponding height of the cone 16, that is to say over the portion of the cone 16 located above the upper edge of ring 19. According to other forms of embodiment, the bell 6 can also be of a smaller or greater length, entering, in the latter case, crushing chamber 17.

The bell 6 thus caps, at least partially, the emerging end 18 of the cone 16.

The outer shell 3 rests, on the frame 20 in the area of the ring 19. If the outer shell 3 is constituted, as the possibility thereof has been referred to earlier, by a chute 12 and by an upper element 13, the chute 12 is then secured, to the frame 20, while upper element 13 is suspended from hopper 4.

In this connection, in the event of an outer shell 3 made in a single element being used, the outer shell 3 is secured, directly or indirectly, to the crusher 2, while remaining free in relation to the hopper 4, under which It is disposed.

Such arrangements thus enable the crusher 2 and the hopper 4 to be dissociated from one another, in this way limiting the transfer of static loads.

It should also be noted that, in order to be able, if so desired, to operate using a wet process, the crusher according to the invention can include means for injecting a fluid, such as, in particular, water, into the crushing chamber 2 from the feeding device 1.

Construction of the feeding device 2 in two parts, 12, 13, facilitates, moreover, such water introduction and distribution. Water can, indeed, be injected at the interface between the upper element 13 and the chute 12.

According to another form of embodiment, arrangements can also be made for injection in the area of bell 6, in residual space 21. For this purpose, the wing members 11 have, a thickness enabling conduits to run through to the bell 6.

This being said, according to one form of embodiment, not illustrated, arrangements could also be made to secure the bell 6 to the said frame 20.

Other forms of embodiment, within the grasp of a man of the art, could, of course, have been contemplated, without thereby departing from the scope of the present application.

What is claimed is:

1. A vibrating mill apparatus comprising:

a crushing chamber;

a vertical cone operatively positioned interior of said crushing chamber; and a feeding means operatively connected to said crushing chamber, said feeding means for passing a flow of material to be crushed to an area between said vertical cone and said crushing chamber, said feeding means comprising:

an outer shell; and a bell member positioned interior of said outer shell and secured to said outer shell, said bell member spaced from and positioned directly over a top of said vertical cone, said bell member being unconnected to said vertical cone, said bell member oriented substantially parallel to a direction of the flow of material so as to divert the flow of material around said top of said vertical cone.

2. The apparatus of claim 1, said bell member having a bottom and extending outwardly beyond an exit of said outer shell.

3. The apparatus of claim 1, said outer shell and said bell member being coaxial.

4. The apparatus of claim 2, said outer shell having a lower element and an upper element, said upper element having a bottom end positioned interior of an opening formed at a top end of said lower element.

5. The apparatus of claim 4, said bell member comprising a cupola secured to said outer shell, said bell member comprising a tubular element positioned below said cupola and secured to said lower element.

6. The apparatus of claim 4, said bell member being of a unitary construction, said bell member being secured to said upper element.

7. The apparatus of claim 1, further comprising:

a plurality of wing members securing said bell member to said outer shell, said plurality of wing members being orientable.

8. The apparatus of claim 1, said top of said vertical cone extending outwardly of a top of said crushing chamber, said bell member capping said top of said vertical cone.

9. The apparatus of claim 1, said crushing chamber comprising a frame having a vibrating rim, said vibrating rim facing said vertical cone, said outer shell resting on said frame adjacent to said vibrating rim.

10. The apparatus of claim 1, further comprising:

fluid injection means positioned adjacent said bell member, said fluid injection means for injecting a fluid into said crushing chamber.

* * * * *